US008246096B2

(12) United States Patent
Blasingame et al.

(10) Patent No.: US 8,246,096 B2
(45) Date of Patent: Aug. 21, 2012

(54) DIFFERENTIAL ACTION RAILROAD CAR AXLE ASSEMBLY

(76) Inventors: Thomas W. Blasingame, Boise, ID (US); Robert E. Hord, Richmond, VA (US)

( * ) Notice: Subject to any disclaimer, the term of this patent is extended or adjusted under 35 U.S.C. 154(b) by 83 days.

(21) Appl. No.: 12/390,009

(22) Filed: Feb. 20, 2009

(65) Prior Publication Data

US 2009/0206623 A1 Aug. 20, 2009

Related U.S. Application Data

(60) Provisional application No. 61/030,050, filed on Feb. 20, 2008.

(51) Int. Cl.
*B60B 35/00* (2006.01)

(52) U.S. Cl. ..... 295/38; 301/132; 180/250

(58) Field of Classification Search ..... 295/37–40, 295/36.1, 42, 42.1, 48, 50; 301/126, 131, 301/132, 124.1, 125; 180/76, 249, 250, 247, 180/53.62; 192/65, 71; 464/102–106, 182; 403/43–46; 280/124.156, 249
See application file for complete search history.

(56) References Cited

U.S. PATENT DOCUMENTS

| | | | | | |
|---|---|---|---|---|---|
| 153,203 | A | * | 7/1874 | Rhodes | 295/39 |
| 180,494 | A | * | 8/1876 | Nelson | 295/39 |
| 187,688 | A | * | 2/1877 | Wells | 295/37 |
| 223,095 | A | * | 12/1879 | Barnes | 295/39 |
| 225,998 | A | * | 3/1880 | Plant | 295/40 |
| 285,509 | A | * | 9/1883 | Peirce | 295/39 |
| 644,822 | A | * | 3/1900 | Hanksworth | 295/38 |
| 691,908 | A | * | 1/1902 | Little | 74/650 |
| 751,243 | A | * | 2/1904 | Austin | 105/49 |
| 925,090 | A | * | 6/1909 | Haigh | 295/39 |
| 962,398 | A | * | 6/1910 | Young | 105/108 |
| 977,002 | A | * | 11/1910 | Girt | 295/38 |
| 1,006,500 | A | * | 10/1911 | Peterson | 192/41 S |
| 1,109,464 | A | * | 9/1914 | Randall | 295/39 |
| 1,118,874 | A | * | 11/1914 | Morgan | 180/53.62 |
| 1,206,583 | A | * | 11/1916 | Palley | 295/37 |
| 1,650,557 | A | * | 11/1927 | Weingartner | 464/104 |
| 2,019,806 | A | * | 11/1935 | Brown | 295/39 |
| 2,079,460 | A | * | 5/1937 | Marty | 464/88 |
| 2,090,327 | A | * | 8/1937 | Haig | 295/39 |
| 2,140,255 | A | * | 12/1938 | Rieske | 464/91 |

(Continued)

OTHER PUBLICATIONS

John A. Elkins; Independently Rotating Wheels: A Simple Modification to Improve The Performance of The Conventional Three-Piece Truck; Ninth International Wheelset Congress; Dec. 15, 1988; pp. 751-758; paper 7-5; Montreal, Quebec.

*Primary Examiner* — Jason Bellinger
(74) *Attorney, Agent, or Firm* — Zarley Law Firm, P.L.C.

(57) ABSTRACT

A differential action railroad car wheelset axle has two individual stub axles, each having one or more annular rings or grooves on the interior ends, with the interior ends of the individual stub axles being rotatably mounted within a multi-piece sleeve assembly. The axle assembly has provision for safety pins to prevent independent rotation during installation in the railcar truck frame and also a device to permit relocking or unlocking the independent axle rotation after the original safety pins have been removed. Dry lubricant coatings eliminate the need for periodic liquid lubrication or maintenance. The differential action of the wheelset reduces the horsepower requirement by approximately 30 percent while also reducing the maintenance requirements for both wheels and track in locations where horizontal curves are predominant.

6 Claims, 5 Drawing Sheets

U.S. PATENT DOCUMENTS 2,488,785 A * 11/1949 Watter ..... 246/34 R
3,802,352 A 4/1974 Keller
4,269,423 A * 5/1981 Perez ..... 280/80.1
4,320,723 A * 3/1982 Wendling et al. ..... 123/41.12
4,603,869 A * 8/1986 Maxwell ..... 280/11
5,105,517 A * 4/1992 Barnow ..... 29/401.1
6,007,126 A 12/1999 Blasingame et al.
6,048,015 A 4/2000 Blasingame et al.
6,598,920 B1 7/2003 Blasingame et al.
6,623,057 B1 9/2003 Blasingame et al.

* cited by examiner

DIFFERENTIAL ACTION RAILROAD CAR AXLE ASSEMBLY

CROSS REFERENCE TO RELATED APPLICATION

This application claims the benefit of U.S. Provisional Application No. 61/030,050 filed Feb. 20, 2008.

BACKGROUND OF THE INVENTION

This invention relates to railroad cars. More specifically, this invention relates to the wheel and axles of railroad cars Wheelsets for railroad cars are usually comprised of a one-piece axle and two wheels. The wheels are pressed onto the axle shaft and are rigidly mounted so that both wheels move exactly the same degree of rotation during operation. In some wheelsets the tread of the wheels is tapered to a larger diameter near the inside flange of the wheel. This tapering of the wheel treads allows a limited amount of relief from the wear and tear of the rigidly mounted wheels on the axle shaft but not enough to fully accommodate the adverse action of the rigid mounting. The conventional wheelset may be supported by journal bearings located outboard of each rigidly mounted wheel or the journal bearings may be located inboard of each rigidly mounted wheel. The rigid mounting of the wheels on the axle and the lack of independent rotation of these rigidly mounted wheels is the cause of slippage on the rail when the wheelset operates on curved sections of track. This slippage causes wear on the wheel treads and is a prime cause of corrective maintenance on both the wheels and the track.

Efforts have been made to overcome the problems associated with the rigid assembly of conventional wheelsets by placing a bearing or bearings between the axle and the wheel on at least one end of the axle to permit differential speeds of rotation on the wheels at opposite ends of the axle. In such cases, a hub is located on at least one end of the axle and a wheel is mounted on the hub or on the axle and its rotation with respect to the axle is facilitated by a bearing assembly.

To allow the operation of signaling systems, electrical continuity is necessary from the rails and through the wheels and the axle. When one of the wheels was mounted on the axle with a bearing assembly, the electrical continuity was sometimes less than perfect. If non-metallic bearings were used the electrical continuity was not possible.

In some cases, the problems associated with the rigid assembly of conventional wheelsets was addressed by providing mechanical mechanisms which could prevent independent wheel rotation one direction and allow rotation in the opposite direction. While such mechanisms could be provided with a certain degree of reliability by judicious design and material selection, the idea of incorporating a number of moving parts into the wheelset was not one that was attractive from a maintenance standpoint.

In other cases, the problems associated with the rigid assembly of conventional wheelsets were addressed by providing both outboard and inboard support members on the truck frame to support outboard and inboard bearings. In such cases, the bearings could be derated from standard sizes for a reduction in weight; however, the total weight of these special truck frames and the additional bearings added a considerable amount of additional weight to the railcar. In addition, in some applications, the inboard bearings or the bearing support arms would interfere with the railroad car frame when operating on curved track.

It is therefore a principal object of this invention to provide a railroad car wheelset with independent rotation of the wheels with respect to each other which will consistently retain the electrical continuity between the opposite wheels and the rails upon which they are supported.

A further object of this invention is to provide a wheelset with independent rotation of the wheels with respect to each other which can be used in existing railroad truck designs without modification to the truck structures or the braking systems.

A still further object of this invention is to provide a railroad wheelset which requires no additional maintenance than conventional wheelsets after installation and during service.

A still further object of this invention is to provide a railroad wheelset with independently rotating wheels in which the differential action is made available with no decrease in safety or reliability.

A still further object of this invention is to provide a railroad car wheelset with independent wheel rotation which can be economically manufactured and applied to railroad cars of all types.

A still further object of this invention is to provide a railroad car wheelset with independent wheel rotation wherein the bearings for the independent rotation system are comprised of a lubricating coating.

A still further object of this invention is to provide a railroad car wheelset in which the wheels can be mounted in substantially the same manner as in conventional wheelsets.

A still further object of this invention is to provide a railroad car wheelset with independent rotating wheels in which the independent rotating wheel action can be locked out during shipment or installation in the truck frame to prevent accidental rotation of the wheelset about the vertical centerline of the axle, and unlocked after the installation in the truck frame for the differential action.

A still further object of this invention is to provide a railroad car wheelset with independent rotating wheels in which the independent rotating wheel action on each axle can be selectively locked in or locked out to provide different operating characteristics to meet uni-directional or bi-directional car movements.

These and other objective will be apparent to those skilled in the art.

BRIEF SUMMARY OF THE INVENTION

The railroad car wheelset of the present invention includes two stub axles which are shaped to include one or more annular retaining rings in the interface area between the mating halves of a multi-piece sleeve assembly. The wheels are permitted to rotate by means of conventional journal bearings either on the extreme ends of the axle or inboard of each wheel location. At the location of the multi-piece sleeve assembly, the stub axles are provided with a smooth surface and a lubricating coating is also provided. Each stub axle shaft is provided with one or more annular retaining rings or other means of preventing the stub axles or their rigidly mounted wheels from migrating laterally out of proper gauge or alignment. The multi-piece sleeve assembly is also equipped with one or more annular retaining rings to mate and cooperate with the two stub axles to maintain the proper lateral alignment under all conditions. The lubricating coating will be specified to conduct electricity in high or low temperatures. A removable connector plate which can act as an electrical contactor may be optionally mounted on each of the stub axle shafts to contact the multi-piece sleeve assembly if the electrical conductivity of the axle assembly requires augmentation. Removable pins or similar devices inserted through holes in the multi-piece sleeve assembly and stub axles prevent independent rotation before the wheelset assembly is installed in the truck frame and these devices are to be removed after installation to activate the differential action. These holes will be plugged with conventional pipe plugs or similar devices after the safety pins are removed.

It is to be understood that in applications requiring powered axles the annular retaining rings mentioned may be in the form of removable mechanical locking devices similar to those used to lock gears on shafts or axles. This will facilitate the installation of the gears on the axle assemblies after the wheels are installed.

DETAILED DESCRIPTION OF THE PREFERRED EMBODIMENT

A conventional prior art wheelset is comprised of a horizontal axle with wheels adjacent its opposite ends. The wheels are each rigidly secured to axle by being pressed on the axle up against two bosses respectively.

Figure 1:
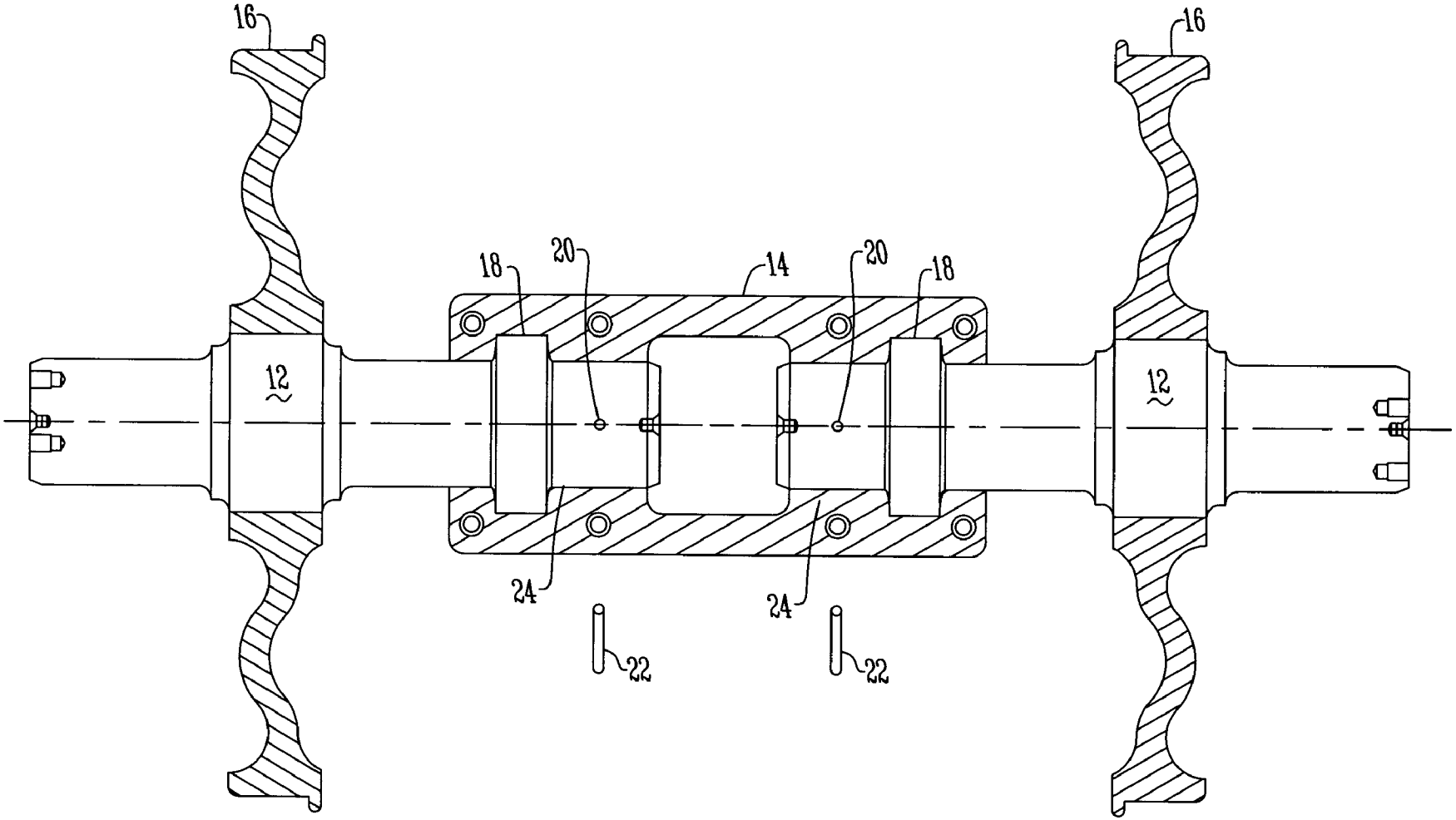
FIG. 1 is a sectional elevation of the preferred embodiment of the railway wheelset of the present invention.
Figure 2:
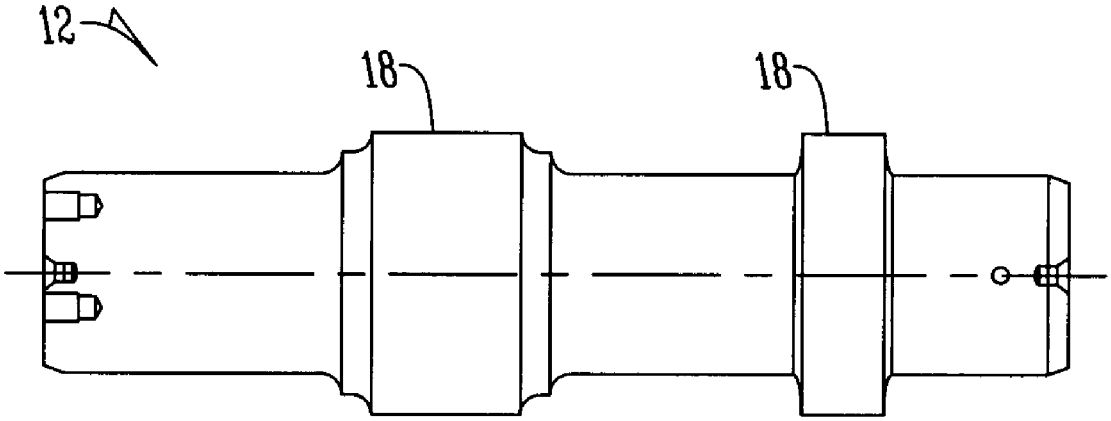
FIG. 2 is an elevation view of the individual stub axle.
Figure 3:
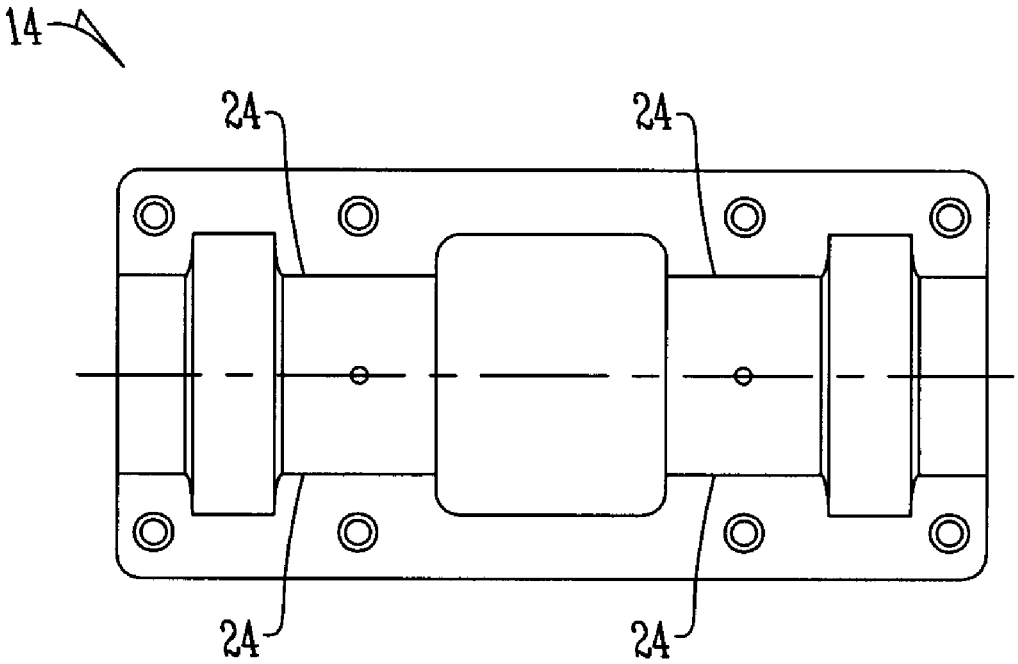
FIG. 3 is a sectional elevation of the multi-piece sleeve assembly.
Figure 3A:
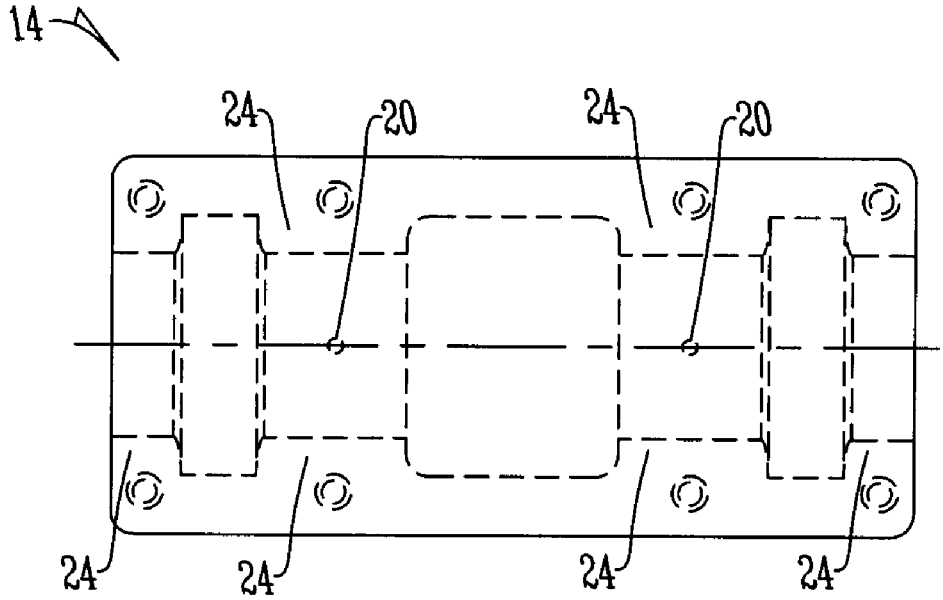
FIG. 3A is a top view of the multi-piece sleeve assembly.
Figure 3B:
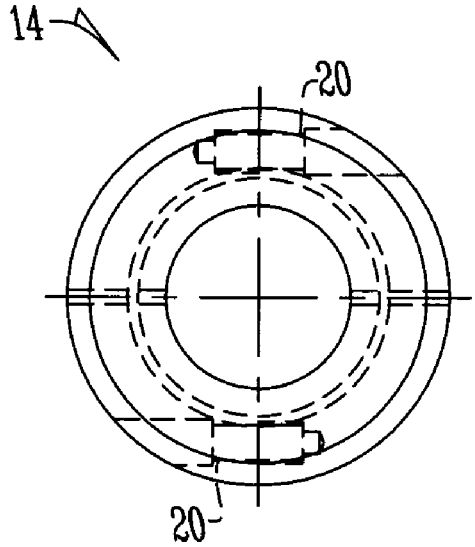
FIG. 3B is an end view of the multi-piece sleeve assembly.
Figure 4:
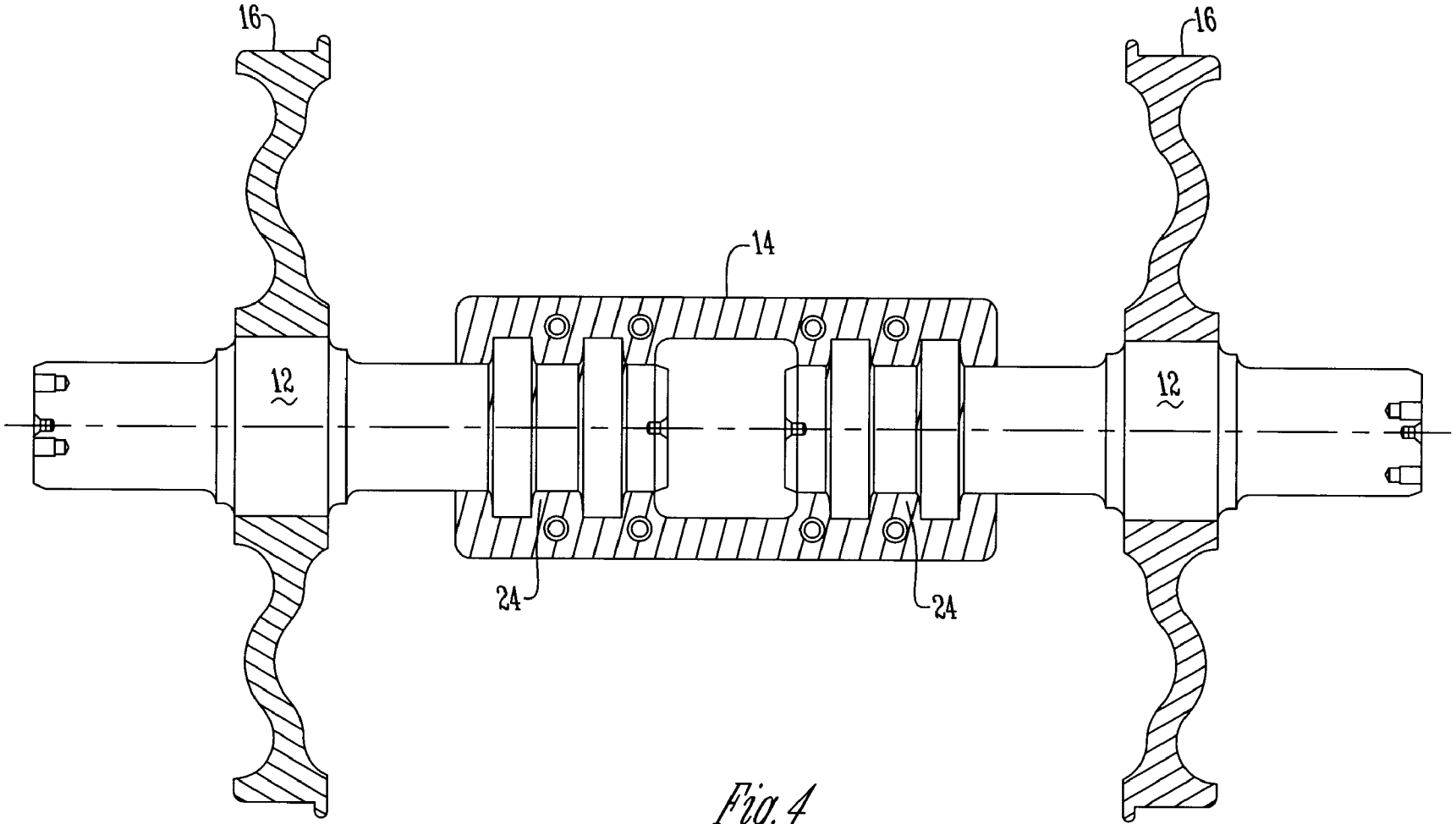
FIG. 4 is a sectional elevation view similar to FIG. 1 but shows an alternative form of the invention.

FIG. 1 shows a railway wheelset assembly 10. While described as a railway wheelset assembly, the assembly 10 is used for both powered rail cars and locomotives. To that end the assembly 10 can be modified to accept the installation of gears or other components as needed. As shown in the rest of the figures the railway wheelset of this invention has individual stub axles 12 and a multi-piece sleeve assembly 14. The stub axles 12 carry wheels 16. The individual stub axles have inner cylindrical interface surfaces with one or more annular raised bosses 18 that serve as retainers to prevent any substantial longitudinal motion and in effect maintain the lateral spacing or gauge of the wheels 16 during operation. At the outer end and cylindrical interface surfaces of each of the individual stub axles 12 are all of the usual features of a typical conventional railway axle as may be required for machining, handling or assembly. At the inner end of the cylindrical interface surface of each of the individual stub axles 12 are located a transverse hole 20 for a removable pin 22 which when installed prevents any independent rotation of the individual stub axle 12 within the multi-piece sleeve assembly. The inner end of each individual stub axle 12 incorporates all of the standard details of a typical conventional railway axle as may be required for machining, handling or assembly.

The multi-piece sleeve assembly 14 has inner cylindrical interface surfaces that are thickened wall portions 24 which also serve as retainers to prevent any substantial longitudinal motion of the individual stub axles 12 and also in effect maintain the lateral spacing or gauge of the wheels during operation. Located at points a distance from the vertical centerline and preferably 6.5 inches from the vertical centerline of the multi-piece sleeve assembly 14 are two transverse holes for the removable pins 22. The outer ends of these two holes may be threaded to accept standard pipe plugs (prior art and not shown) or plastic plugs (prior art and not shown). Each component of the multi-piece sleeve assembly 14 has a plurality of recessed and/or threaded bolt holes for use in making a proper high strength connection between these components in compliance with railroad industry standards.

Both the individual stub axles 12 and the multi-piece sleeve assembly 14 shall be given an approved cyrogencic heat treatment prior to coating the components with an approved dry lubricant, or as otherwise specified or required by railway industry or government regulations.

The common interface surfaces of the two individual stub axles 12 and the multi-piece sleeve assembly 14 shall be machined to provide the optimum bond between the metallic surface and an approved high and cold temperature tolerant dry lubricant. This lubricant shall be preferably applied to the sleeve interfacing surfaces of both individual stub axles 12 and the multi-piece sleeve assembly 14.

Figure 5:
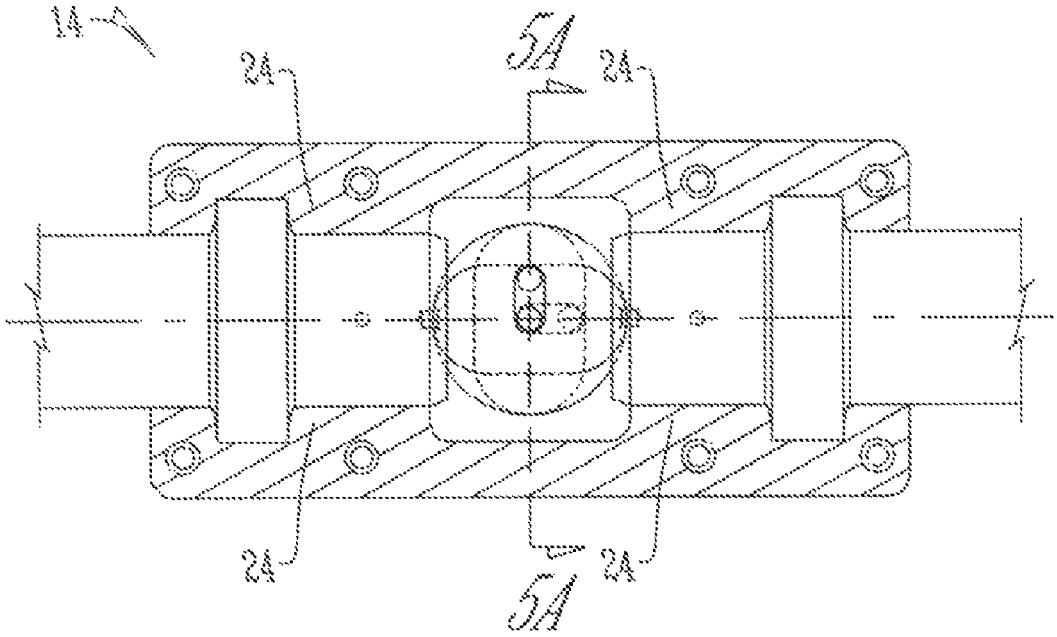
FIG. 5 is a sectional elevation view similar to FIG. 1 but shows an alternative form of the invention with additional parts to allow selectively locking in or locking out the differential action on each axle.
Figure 5A:
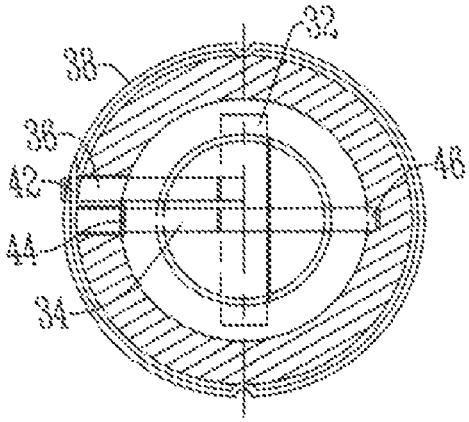
FIG. 5A is a sectional view of a multi-piece sleeve assembly.

FIG. 5A is a sectional elevation view and shows an alternative form of the invention modified and provided with additional parts to allow selectively locking in or locking out the differential action on each axle 12. The interior ends of each individual stub axle 12 are provided which can receive a rotatable tongue member 32 mounted on a transverse drive shaft 34. A second transverse shaft 36 acts as a follower to urge the rotatable tongue member 32 to rotate in the ends of the two individual stub axles 12 when an exterior grooved sleeve 38 is moved longitudinally to the right. The exterior grooved sleeve 38 has an exterior opening 40 which bears on an eccentric arm 42 mounted on the end of the second transverse shaft 36 to provide the rotary motion to the rotatable tongue member 32. This transverse drive shaft 34 has an integral collar 44 which prevents it from escaping from inside the multi-piece sleeve assembly 14, and the far end of transverse drive shaft 34 mounts in a recess 46 in the side wall of the multi-piece sleeve assembly 14. All of the components in this mechanism are to receive the same dry lubricant coating as previously described.

The requirements for electrical conductivity through this wheelset assembly 10 can be provided in some cases by the dry lubricant coating. In those cases where insufficient electrical conductivity is provided by the dry lubricant coating, a bolt-on clamp collar can be attached to each of the individual stub axles 12 to bear against the ends of the multi-piece sleeve assembly. This arrangement serves to pass the electric current through the axle assembly in an acceptable manner. Such bolt-on clamp collars are prior art.

It is therefore seen that the wheelsets wheelset assembly of this invention can be easily manufactured and assembled and can provide a wheelset assembly that can be used in a fully unlocked condition where all wheels rotate independently, in an intermediate condition where one axle operates with all wheels rotating independently, and the other axle operates with all wheels locked rigidly, or a third condition where all wheels operate locked rigidly as in a standard conventional wheelset assembly. It is therefore seen that this invention will achieve at least all of its stated objectives.

It will be appreciated by those skilled in the art that other various modifications could be made to the device without departing from the spirit and scope of this invention. All such modifications and changes fall within the scope of the claims and are intended to be covered thereby.

What is claimed is:

1. A railroad car wheelset assembly comprising:

a first stub axle having a hole disposed therethrough;

a second stub axle having a hole disposed therethrough;

a multi-piece sleeve that rotatably engages the first and second stub axles that rotate within the multi-piece sleeve;

said multi-piece sleeve having a first hole disposed therethrough that aligns with the hole of the first stub axle and a second hole disposed therethrough that aligns with the hole of the second stub axle; and a first removable pin disposed through the hole of the first stub axle and the first hole of the multi-piece sleeve and a second removable pin disposed through the hole of the second stub axle and the second hole of the multi-piece sleeve such that either of the first and second stub axles are locked to selectively prevent independent rotation of the first stub axle and the second stub axle within the multi-piece sleeve; and wherein both of the first and second stub axles are locked within the multi-piece sleeve such that wheels carried by the first and second stub axles rotate uni-directionally with the same degree of rotation when both the first and second removable pins are installed within the multi-piece sleeve.

2. The assembly of claim 1 wherein the multi-piece sleeve has a plurality of thickened wall sections which matingly align with one or more annular bosses of the first stub axle to prevent lateral motion of the first stub axle.

3. The assembly of claim 1 further comprising dry lubricant coatings on each interface between the first stub axle and the multi-piece sleeve and dry lubricant coatings on each interface between the second stub axle and the multi-piece sleeve.

4. The assembly of claim 1 wherein the railroad car wheelset assembly is incorporated into a locomotive.

5. The assembly of claim 1 wherein the railroad car wheelset assembly is incorporated into a powered rail car.

6. The assembly of claim 1 wherein the multi-piece sleeve has a plurality of thickened wall sections which matingly align with one or more annular bosses of the first stub axle and one or more annular bosses of the second stub axle to prevent lateral motion of the first and second stub axles.

* * * * *